US007269930B2

(12) United States Patent
Kahlisch et al.

(10) Patent No.: US 7,269,930 B2
(45) Date of Patent: Sep. 18, 2007

(54) BEVERAGE BOTTLING PLANT FOR FILLING BOTTLES WITH A LIQUID BEVERAGE FILLING MATERIAL HAVING A DEVICE FOR LABELING OF CONTAINERS WITH CONTINUOUS FEEDING OF LABELS, EVEN UPON SOME LABEL SUPPLY ARRANGEMENTS BEING EMPTIED OF LABELS

(75) Inventors: Paul-Gerhard Kahlisch, Fröndenberg (DE); Klaus-Friedrich Stock, Dortmund (DE); Heinz Thielmann, Dortmund (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 40 days.

(21) Appl. No.: 11/154,294

(22) Filed: Jun. 16, 2005

(65) Prior Publication Data

US 2006/0010836 A1 Jan. 19, 2006

(30) Foreign Application Priority Data

Jun. 19, 2004 (DE) ..... 10 2004 029 788

(51) Int. Cl.
*B65B 61/00* (2006.01)
*B65C 9/10* (2006.01)

(52) U.S. Cl. ..... 53/136.1; 53/64; 53/167; 53/281; 53/308; 156/493; 156/567

(58) Field of Classification Search ..... 53/64, 53/136.1, 137.2, 167, 281, 308; 156/475, 156/488, 492, 493, 556, 566, 578, 567; 141/129
See application file for complete search history.

(56) References Cited

U.S. PATENT DOCUMENTS

| | | | | | |
|---|---|---|---|---|---|
| 3,134,707 | A | | 5/1964 | Carter | |
| 3,779,829 | A | * | 12/1973 | Wolff | 156/566 |
| 4,098,183 | A | * | 7/1978 | Johnson | 101/40 |
| 4,210,481 | A | * | 7/1980 | Wolff et al. | 156/571 |
| 4,306,926 | A | * | 12/1981 | Pfulb | 156/567 |
| 4,316,762 | A | * | 2/1982 | Martin | 156/493 |
| 4,325,775 | A | * | 4/1982 | Moeller | 156/584 |
| 4,336,095 | A | * | 6/1982 | Hoffmann | 156/542 |
| 4,362,594 | A | * | 12/1982 | Nagano et al. | 156/567 |
| 4,368,097 | A | * | 1/1983 | Clowe | 156/578 |
| 4,428,474 | A | * | 1/1984 | Gau et al. | 198/394 |
| 4,430,141 | A | * | 2/1984 | Zodrow | 156/475 |
| 4,437,289 | A | * | 3/1984 | Bedin | 53/64 |

(Continued)

FOREIGN PATENT DOCUMENTS

| | | |
|---|---|---|
| DE | GM75 40 566 | 5/1976 |

(Continued)

*Primary Examiner*—Louis Huynh
(74) *Attorney, Agent, or Firm*—Nils H. Ljungman & Associates

(57) ABSTRACT

A beverage bottling plant for filling bottles or containers with a liquid beverage which has a labeling device for labeling the bottles or containers. The labeling device has at least two labeling stations, wherein at least one labeling station can be moved from an operating position to a rest position when its supply of labels is exhausted, while at least one other labeling station can be moved from a rest position to an operating position to permit a substantially continuous feed and application of labels to bottles or containers.

20 Claims, 8 Drawing Sheets

U.S. PATENT DOCUMENTS 4,443,289 A * 4/1984 Kolges et al. ..... 156/571
4,594,123 A * 6/1986 Eder ..... 156/567
4,683,835 A * 8/1987 Kronseder ..... 118/231
4,721,544 A * 1/1988 Zodrow et al. ..... 156/578
5,174,851 A * 12/1992 Zodrow et al. ..... 156/566
5,188,696 A 2/1993 Good, Jr. et al.
5,215,622 A * 6/1993 Schmelzer ..... 156/566
5,713,403 A * 2/1998 Clusserath et al. ..... 141/129
6,189,578 B1 * 2/2001 Clusserath ..... 141/40
6,213,169 B1 * 4/2001 Clusserath ..... 141/40
6,428,639 B1 8/2002 Oldenburg et al.
6,463,964 B2 * 10/2002 Clusserath ..... 141/40
6,470,922 B2 * 10/2002 Sindermann ..... 141/49
6,474,368 B2 * 11/2002 Clusserath et al. ..... 141/129
6,752,189 B2 * 6/2004 Oldenburg et al. ..... 156/541
6,796,352 B1 * 9/2004 Geurtsen et al. ..... 156/566

FOREIGN PATENT DOCUMENTS

DE 33 40 339 A1 5/1985
DE 94 11 443 U1 9/1995
DE 102 27 065 A1 12/2003
EP 0 501 105 A1 9/1992
EP 0 624 522 A1 11/1994

* cited by examiner

BEVERAGE BOTTLING PLANT FOR FILLING BOTTLES WITH A LIQUID BEVERAGE FILLING MATERIAL HAVING A DEVICE FOR LABELING OF CONTAINERS WITH CONTINUOUS FEEDING OF LABELS, EVEN UPON SOME LABEL SUPPLY ARRANGEMENTS BEING EMPTIED OF LABELS

BACKGROUND

1. Technical Field

The present application relates to a beverage bottling plant for filling bottles with a liquid beverage having a device for labeling containers such as bottles, cans and other containers and types of packaging with a container conveyor and labeling stations positioned on its periphery so that they work in alternation, with a label transfer and dispensing device for labels that are attached to a carrier strip as described hereinbelow.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

In the context of this application, the term "container" is used for vessels that contain any desired products such as, for example, beverages, foods, medicines etc., such as bottles, cans, jars with and without screw caps etc. For purposes of simplification, the term "container" is often used below.

The present application is thereby based on a continuously operating labeling device, in which the containers are moved with a superimposed independent rotation on a conveyor track and the labels that are fastened to a carrier strip are moved by said carrier strip.

During the transfer of the labels to the containers, the containers and labels come into contact at the transfer point and move at the same velocity. The initial attachment of the labels to the containers is achieved by their self-adhesive properties. The subsequent attachment and fixing in position of the rest of the label is done by applying pressure or brushing elements, whereby these elements contribute to the smooth and defect-free fastening of the labels on the containers.

The present application further relates to a corresponding device which comprises a driven endless or circular transport track with rotating receptacles located at uniform intervals for the containers, of a driven endless carrier strip with labels at uniform intervals, and of a contact area that is realized in the form of a transfer point between the transport track and the containers that are moving on said transport track and the carrier strip, whereby in the vicinity of the transfer point there are means that exert pressure forces and/or tensile forces on the labels to ensure the correct attachment of the labels to the containers.

These means can be, among other things, brush elements, expanded foam pads, plastic pads or similar elements.

Devices of this type are used in the food and beverage industries, among others, for the decoration and labeling of packages made of paper, plastic, glass or metal.

In one device of this type of the prior art that is used in many different types of container labeling machines, the applicators that are made of a sponge-rubber pad sit on the end of levers, which are mounted on their other end so that they can pivot around axes that run parallel to the direction of reciprocal travel of the centering bells that hold the containers in position. By means of a control cam, the levers, after the attachment of a label to the inclined or vertical neck of the bottle, are pivoted toward the bottle, whereupon the pressure device while the ends of the label are brushed on.

The device of the prior art is quite suitable for the purpose described above, i.e. for the additional fixing of labels on the surfaces or bottles that are perpendicular or at a slight inclination to the center axis of the container. One disadvantage, however, is that on account of the geometric relationships during the application of the presser against the container, in particular against inclined surfaces, uncontrolled sliding movements occur in the plane of the label. These sliding movements are more pronounced, the greater the inclination of the surface of the container to which the label is being applied, and the stronger the pressure applied by the presser. These factors result in an undesirable shifting of the labels and a non-uniform, unattractive appearance of the labeled containers. On the device of the prior art, when there are variations in the height of the vessels, which is unavoidable in actual practice, the surface over which the presser is applied to the container varies, as a result of which the labels are likewise shifted or the application pressure applied is insufficient. The device of the prior art is therefore unsuitable for a single-step, exclusive and permanent application of labels to the surfaces of containers.

DE-OS-7540 teaches that each centering bell is associated with a holder that is movably located on the upper table, which holder is in a driven connection with the centering bell and can be raised and lowered with the centering bell, whereby on each holder, a presser is mounted by means of a linear guide so that it can be moved perpendicular to its work surface, and the linear guide is inclined with respect to the horizontal so that the presser contacts the inclined surface of the container perpendicularly with at least the middle portion of its work surface.

In this device of the prior art, the pressers are automatically set to the correct height because they are in a driven connection with the centering bells, so that the label is always applied to the desired portion of the container. Therefore, for example, even labels that are located in depressions on the container can be applied correctly and reliably. Moreover, on account of the special linear guidance of the presser, even at a high application pressures, no uncontrolled sliding movements can occur, which guarantees an accurate and solid seating of the label. One disadvantage of this device of the prior art, however, is that each centering bell has its own presser, which on modern high-capacity machines that have a plurality of container receptacles, entails major effort and expense in terms of cost, service and maintenance, and is no longer desirable for economic reasons.

German Utility Model 94 11 443 also describes a labeling machine with a carrier strip for the application of labels to objects, in particular cans, bottles and similar containers, in which to release a label, the carrier strip is pulled around a dispensing edge, and the label with its adhesive surface is delivered to the external cylindrical surface of a container that is held rotationally between a presser roller and two backup rollers opposite the presser roller and is transferred onto the container, whereby the containers are continuously transported past the stationary dispensing edge and the at least one presser roller and the backup rollers located opposite it can travel with the container for at least a short distance from the dispensing edge in the direction in which the container is being transported, and can then be returned to the starting position close to the dispensing edge.

EP 0 501 105 also discloses an additional labeling device with a cone-shaped vacuum cylinder. With this device, it is possible to process cut-out labels that are located centrally and therefore in a space-saving manner on a backing strip. One unsatisfactory feature of this invention, however, is the undefined transfer of the self-adhesive cut-out labels to the conical vacuum cylinder in the vicinity of the dispensing edge, because the cut-out labels must have a defined orientation of their leading edge with reference to the surface line of the container not later than when they are applied to the conical shoulder surface of the container being labeled, to ensure a correctly positioned transfer to the external cylindrical surface of the container.

The prior art also describes solutions in which, instead of a dispensing device with a dispensing edge or a vacuum drum, purely mechanical transfer drums can be used. In such applications, however, a corresponding pressing of the transferred label is also necessary.

OBJECT OR OBJECTS

The object is to apply labels of the desired quality under high-capacity conditions on various container diameters and on different external surfaces on rotating containers that are rotating and are preferably moved on a rotating container table or in line, whereby this application can also be guaranteed without an interruption of the labeling process in alternation with a plurality of redundantly operating label transfer devices.

The present application teaches that this object can be accomplished by the features disclosed in the following description.

SUMMARY

As a result of the arrangement of two or more self-adhesive labeling stations that operate in alternation, i.e. continuously, it is possible to achieve a continuous labeling of the containers to be processed.

However, when switching from a first labeling station to a second labeling station, this method, which is altogether advantageous, requires the likewise immediate alternation of the guide and pressing elements, which means that the elements that are associated with the labeling station that is no longer being used must be moved immediately out of the path of the points of contact between elements and containers, while on the other hand the elements of the labeling station that is now being used must be moved into this path.

The alternation of the guide and presser elements must be immediate, because as a result of a forces exerted by the elements that are not required for the fastening of the labels, there could be undesirable effects on the containers. These undesirable effects may include, for example, a change in the orientation of a container between two labeling processes, which would result in incorrectly positioned labels, which will be clearly apparent to the consumer, especially on molded or contoured containers.

This rapid alternation of the guide and pressing elements is guaranteed by the configuration taught by the present application.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other

BRIEF DESCRIPTION OF THE DRAWINGS

Developments, advantages and potential applications of the present application are presented in the following description of exemplary embodiments and from the accompanying drawing. All the features described and/or illustrated in the drawings are the object of the present application, in isolation or in any possible combination, regardless of their placement in the claims or the references between claims. The text of the claims is also incorporated by reference into the description.

The present application is explained in greater detail below on the basis of the exemplary embodiments illustrated in the accompanying drawings, in which.

DESCRIPTION OF EMBODIMENT OR EMBODIMENTS

Figure 1:
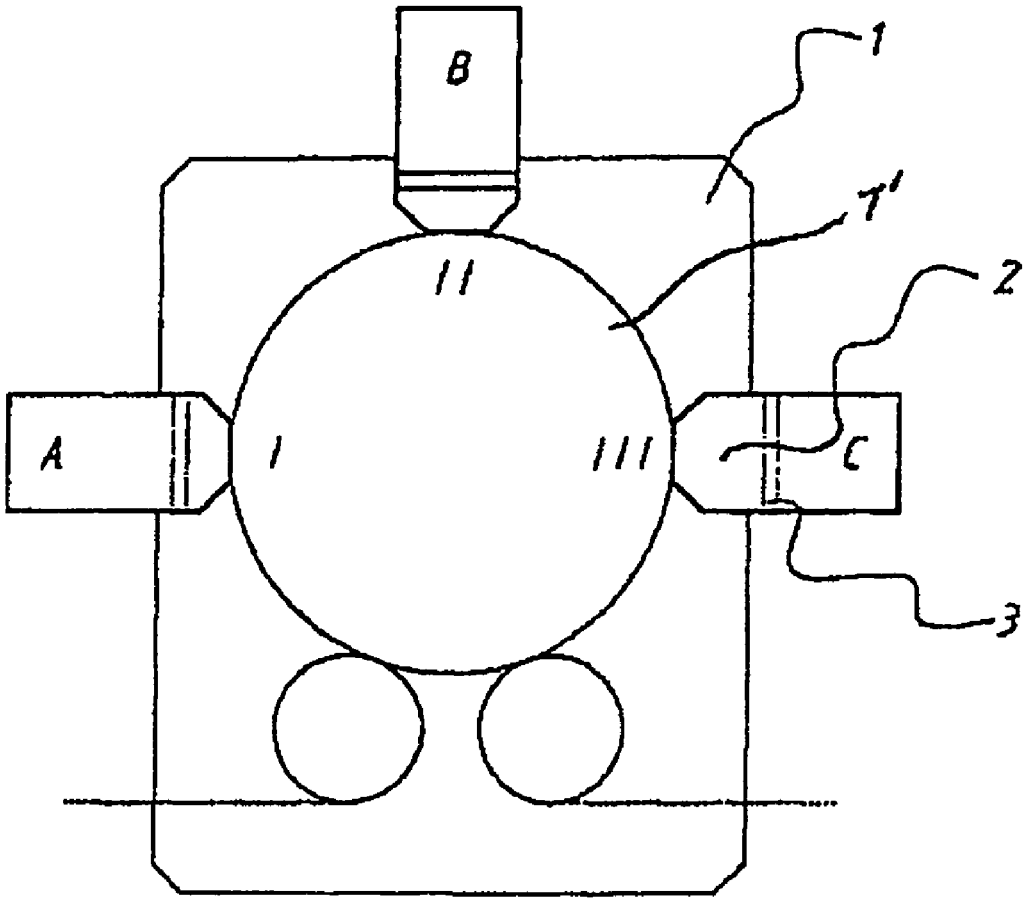
FIG. 1 is a simplified view of a labeling machine of the prior art that is shown by way of example.
Figure 1A:
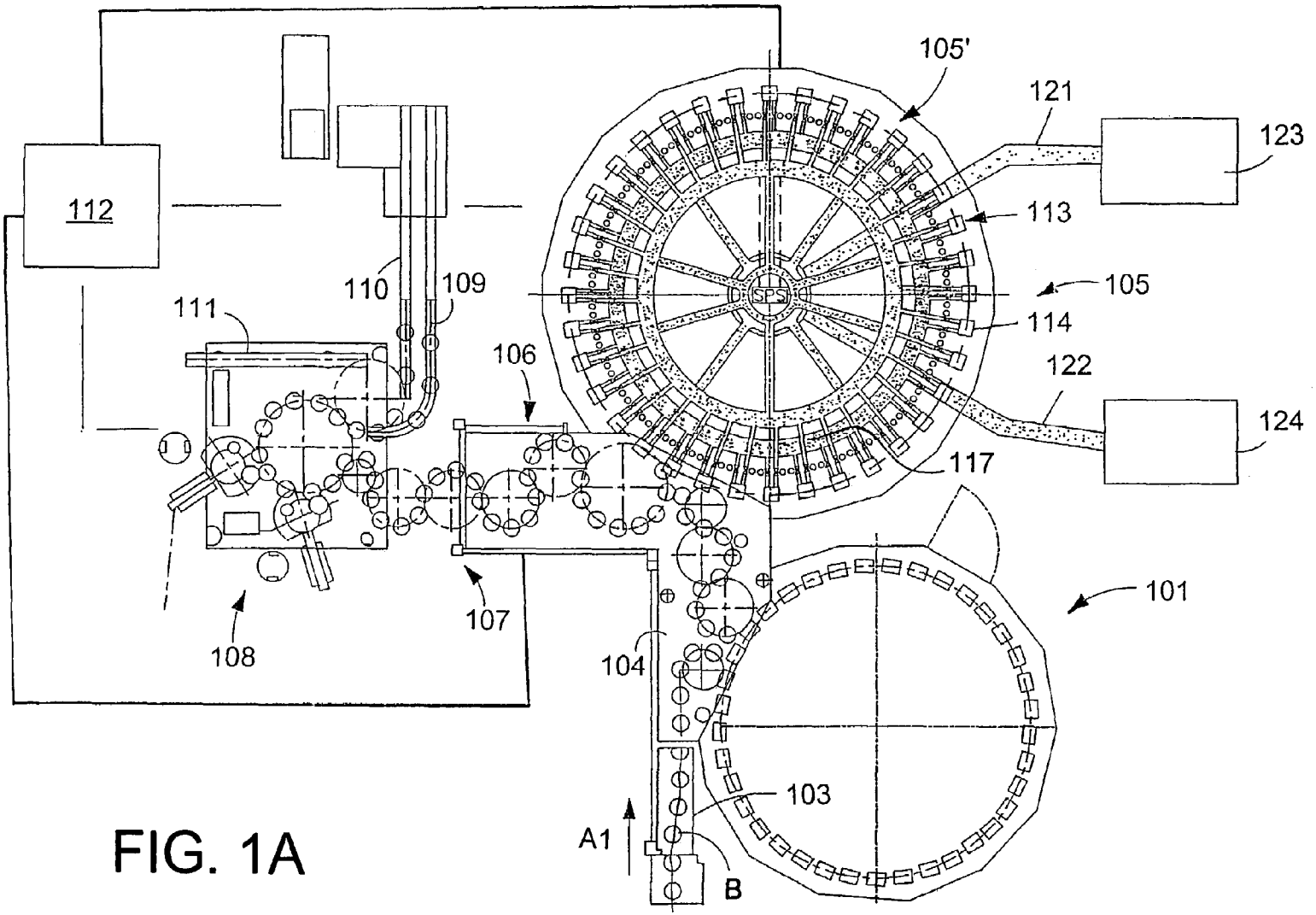
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement or system 112, which could be, for example, computerized control system that monitors and controls the operation of the various stations and mechanisms of the beverage bottling plant.

In an exemplary embodiment illustrated in FIG. 1, a labeling machine of this type comprises, for example, the actual machine foundation 1, which holds the drive and control devices and the additional units required, as well as the turntable 1' which is equipped with container plates (not shown). Attached to or on the machine foundation 1, in the vicinity of the turntable 1' or its periphery, there are one or more adapters 2 with a standard interface 3, to which identical and/or different labeling stations A-C can be docked. The adapters 2 appropriately have standard mechanical and electrical interfaces 3, whereby there can also be coupling elements to drive the labeling stations, unless the labeling stations are driven independently or automatically by servomotors.

The adapters are also attached to the periphery of the labeling machine so that they can be adjusted in different positions, as a result of which there are additional variation capabilities, in particular for the orientation of the labeling stations on specified variants of the machine.

For example, the labeling stations A-C can be located on a transport device that can be moved toward and docked with the different adapters. The turntable 1' and its plates, as well as the labeling stations, can be equipped with their own drive devices, e.g. servomotors. There are various possibilities for the layout of the adapters, so that the labeling stations can be delivered and docked to the labeling machine in the horizontal plane or end-to-end.

Figure 2:
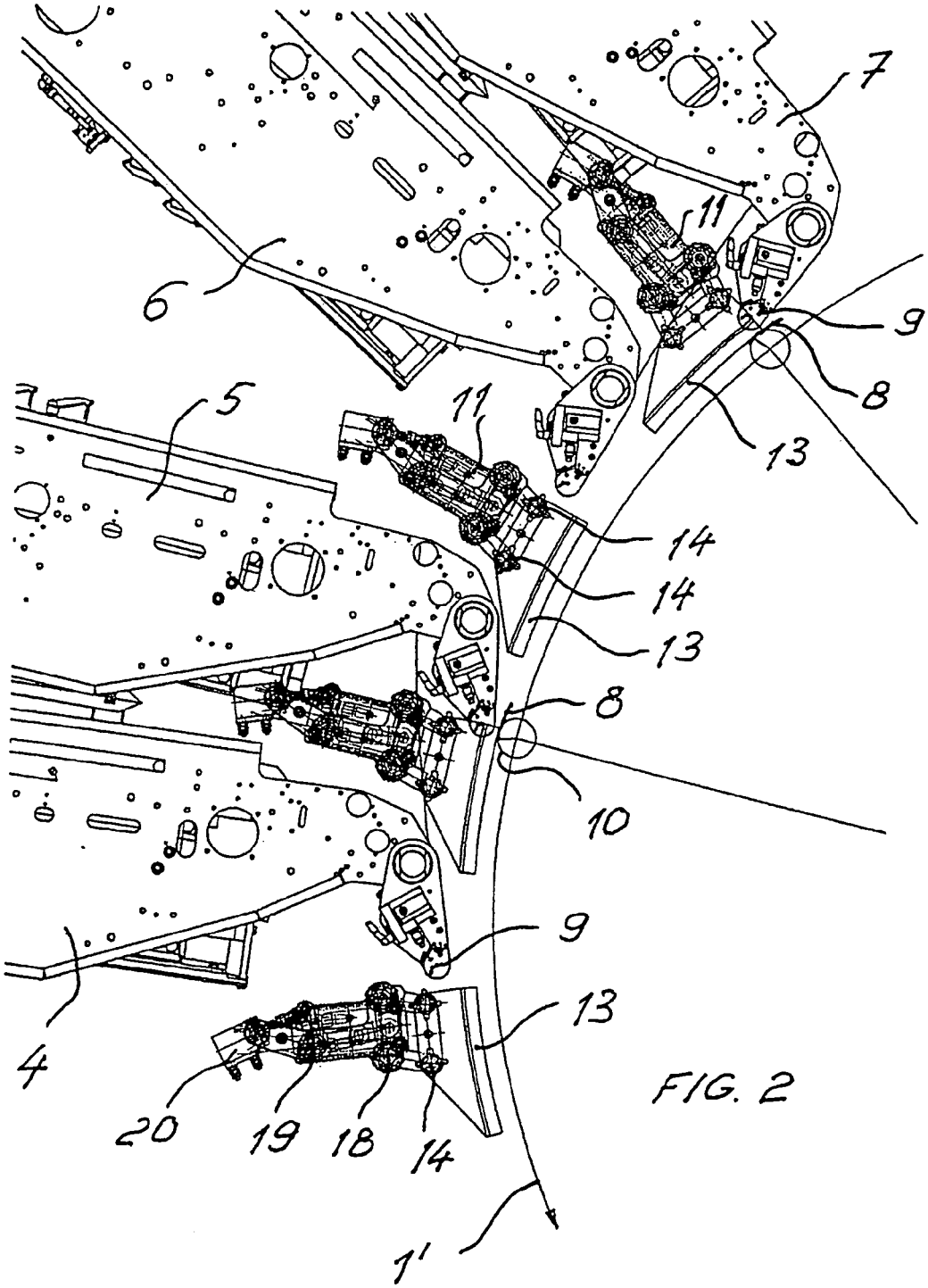
FIG. 2 is a view of the realization taught by the present application with, by way of example, two self-adhesive labeling stations located one after the other.

FIG. 2 shows such a machine with self-adhesive labeling stations 4, 5, 6 and 7 located on the rotational periphery of the turntable 1', whereby the stations 4, 5 and 6, 7 work together in a redundant or alternating sequence of operations. In the illustrated exemplary embodiment, for example, the stations 4, 5 can be provided in alternation to label the neck and back, and 6, 7 to label the shoulder or body. The stations are designed for processing self-adhesive labels 8, which are delivered to the label transfer and dispensing device 9 on a carrier strip (not shown), and are released by means of a dispensing edge for transfer to the external surface 10 of the container. Instead of a dispensing device 9 of this type, other types of transfer devices can also be used, such as vacuum drums or transfer drums that operate purely mechanically.

The actual presser device 11 is immediately adjacent to the area of the label transfer and dispensing device 9, and the task of the presser device 11 is to press a label 8 that has just been applied to the surface 10 of the container until it is perfectly smooth. A presser device 11 of this type, in the embodiment illustrated in FIG. 3, comprises two presser elements 13 that are held at a distance from each other in a receptacle 12, and can be removably mounted by means of a fast-change device 14, and in this manner allows a rapid conversion to other types of containers.

Instead of the presser elements 13 that are realized in a single unit at a distance from one another, the presser elements 13 can also be mounted individually on a presser device 11. These presser elements 13 have a holder 15 with slots 16 for the optimal setting of the plane of application 17 with reference to the type containers to be processed. A precision adjustment mechanism can also be provided.

In the illustration in FIG. 2, the presser elements 13 are mounted with their holders 15 in the presser device 11 on a coupler mechanism 18 in the horizontal plane preferably so that they can be pivoted in and out. For the rapid pivoting of the presser elements 13 in and out, there is a drive element 20 that can be engaged directly or indirectly on the coupling mechanism 18. On this drive element 20, for example, there can be an electrical actuator motor, pneumatic or hydraulic cylinders or also linear drives.

The adjustment in the horizontal plane, depending on the realization of the mounting, can also take place in other planes. It is also conceivable to associate a presser device 11 that is adjusted to the appropriate height with each presser element 13. The presser elements 13 have a contour that matches the respective corresponding container surface. Such presser elements 13, however, can also be formed from a plane that can be varied as appropriate and to the container surface to the processed. The plane of the presser elements 13 can also be divided into a plurality of individual subplanes, the position of which can be automatically adjusted and adapted to the corresponding container surface by means of automatically actuated adjustment elements. In particular when there is a plurality of different types of containers and relatively large adjustment distances, a multi-axis positioning unit can also be provided for the respective presser devices or a correspondingly actuated rotation device.

As also shown in FIG. 2, the labeling stations 5 and 7 with their associated presser devices 11 are in the work position and the labeling stations 4 and 6 are in the idle or loading or reloading position. For example, for each label there are two label dispensers 4, 5 and 6, 7 on the labeling machine turntable 1'. When the labeling stations 5, 7 are active, as soon as the label supply is exhausted, there is an automatic switchover to the stations 4 and 6, which have in the meantime been reloaded, with a corresponding switchover of the respective associated presser devices 11, so that the containers can continue to be labeled without interruption. In this manner, the otherwise unavoidable shutdown times and conversion work can be eliminated. The labeling stations 4-7, as shown in FIG. 1, the docking stations A-C can also be connected in the conventional manner by pivots or inserted or plugged into the machine foundation 1 and driven.

Figure 3:
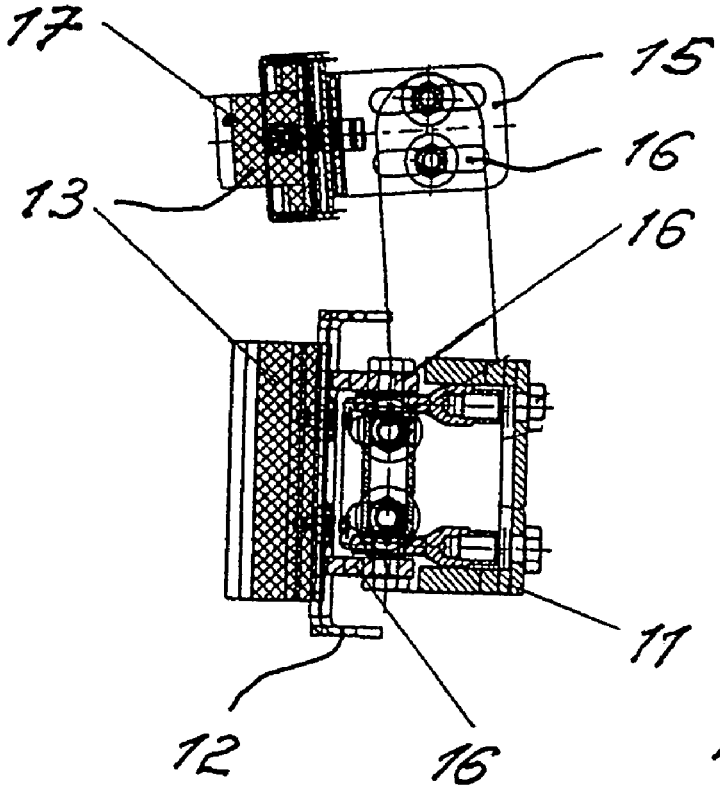
FIG. 3 is a cross section through an arrangement of pressing elements.
Figure 4:
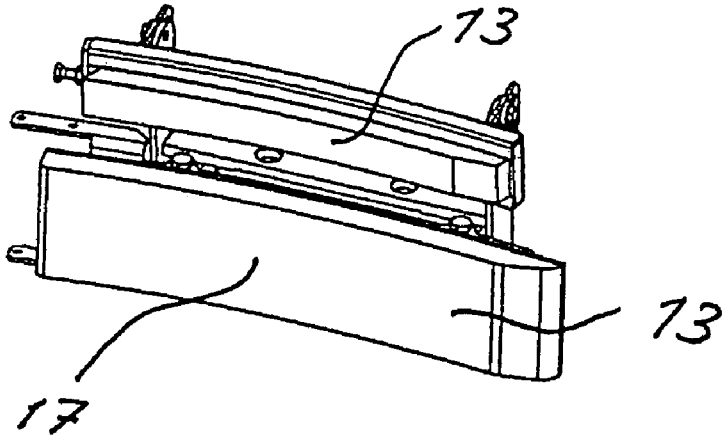
FIG. 4 is a head-on view of FIG. 3.

FIG. 4 shows a head-on view of FIG. 3. The plane of application 17 of the presser element 13 is shown, according to the embodiment shown in FIG. 3. The presser element 13 may be different sizes or shapes, according to which type of bottle or container to which it is applying labels.

Figure 2A:
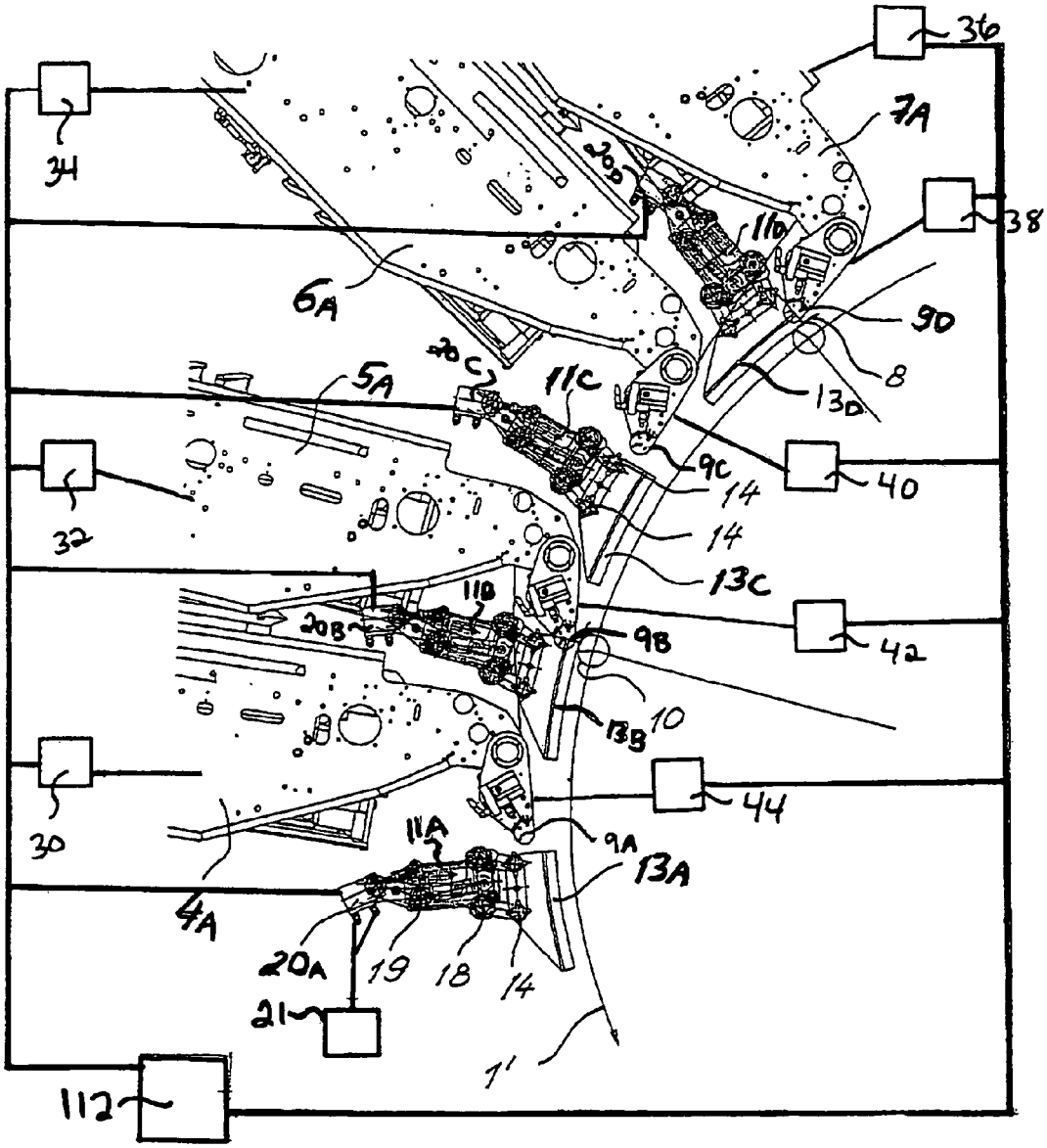
FIG. 2A is similar to FIG. 2, and shows further details according to the possible embodiment shown in FIG. 2.

In one possible embodiment, according to FIG. 2A, the presser elements 13A, 13B, 13C, and 13D are detachably connected to their associated presser devices 11A, 11B, 11C, and 11D, respectfully. FIG. 2A shows the labeling stations 5A and 7A in an engaged position to apply labels to the surface 10 of bottles or containers. FIG. 2A further shows labeling stations 4A and 6A in a disengaged position, for instance, to refill an empty label supply arrangement. Each of the labeling stations 4A, 5A, 6A, and 7A could have a corresponding actuator element 30, 32, 34, and 36, respectively, to move the labeling stations 4A-7A forward into an engaged position, and back to a disengaged position upon the exhaustion of the label supply. Each of the labeling stations could have its own actuator device so that each label transfer and labeling device could hold different size labels, which different size labels would run out at different intervals. In this possible embodiment, each of the pressure devices 11A-11D are immediately adjacent to the area of their corresponding label transfer and dispensing devices 9A-11D, respectfully. The task of the presser devices 11A-11D is to press a label 8 that has just been applied to the surface 10 of the container with the presser elements 13A-13D until the label is perfectly smooth on the surface of the bottle.

Each of the label transfer and dispensing devices 9A-9D could have a corresponding sensor to determine when the label supply arrangement is empty and needs to be changed or refilled. In FIG. 2A, label transfer and dispensing device 9A has corresponding sensor 44, label transfer and dispensing device 9B has corresponding sensor 42, label transfer and dispensing device 9C has corresponding sensor 40, and label transfer and dispensing device 9D has corresponding sensor 38.

Each of the sensors 38-44 could send a signal to the control system 112 upon their corresponding label transfer and dispensing devices 38-44 needing a new charge of labels. The control system 112 could then send a signal to the corresponding actuator device 30, 32, 34, or 36, in order to pull its corresponding labeling station 4A, 5A, 6A, or 7A into a disengaged position. The control system 112 could also send a signal to each of the presser actuating devices 20A, 20B, 20C, and 20D, which presser actuating devices could have a pneumatic element or actuator motor 21, in order to pull the corresponding presser device substantially out of the path of moving bottles while its corresponding label transfer and dispensing device is being refilled with labels. The pneumatic element or actuator motor 21 is shown in FIG. 2A only for the presser actuating device 20A, but represents a pneumatic element or actuator motor for each of the presser actuating devices 20A, 20B, 20C, and 20D.

As shown in FIG. 2A, when one or more of the label transfer and dispensing devices 38-44 require a new charge of labels, they are pulled into a disengaged position by their corresponding actuator, such as labeling stations 4A and 6A in FIG. 2A. Substantially instantaneously, the labeling stations in a disengaged position, for instance, 5A and 7A in FIG. 2A, are pushed by their corresponding actuators into an engaged position. Since the switch of the positions of the labeling stations is substantially instantaneous, almost no time is lost, and it is possible to achieve a continuous labeling of the containers to be processed.

Figure 5:
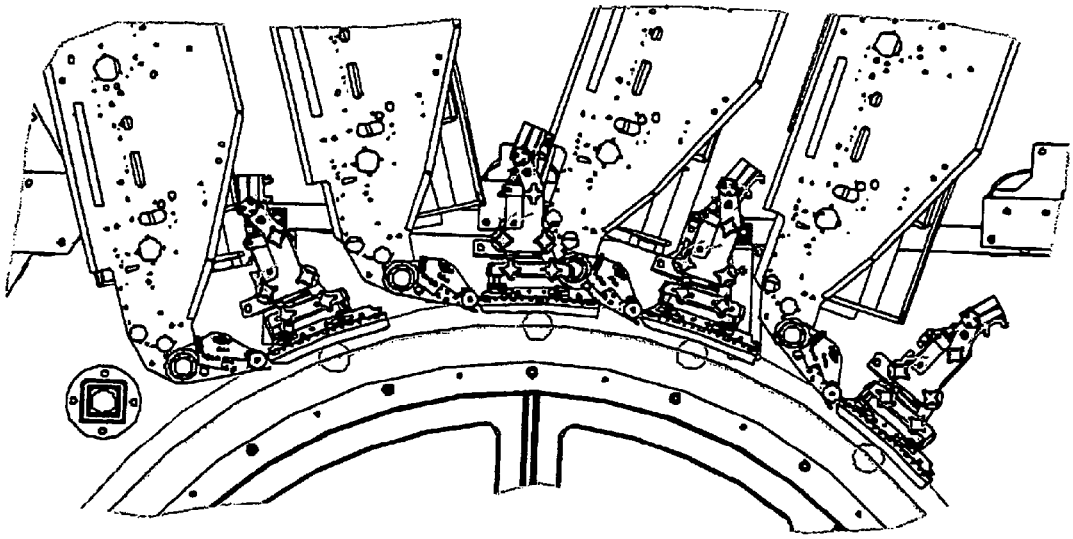
FIG. 5 is similar to FIG. 2 and shows two self-adhesive labeling stations located one after the other, according to one possible embodiment.

FIG. 5 is similar to FIG. 2 and shows two self-adhesive labeling stations located one after the other, according to another possible embodiment.

Figure 6:
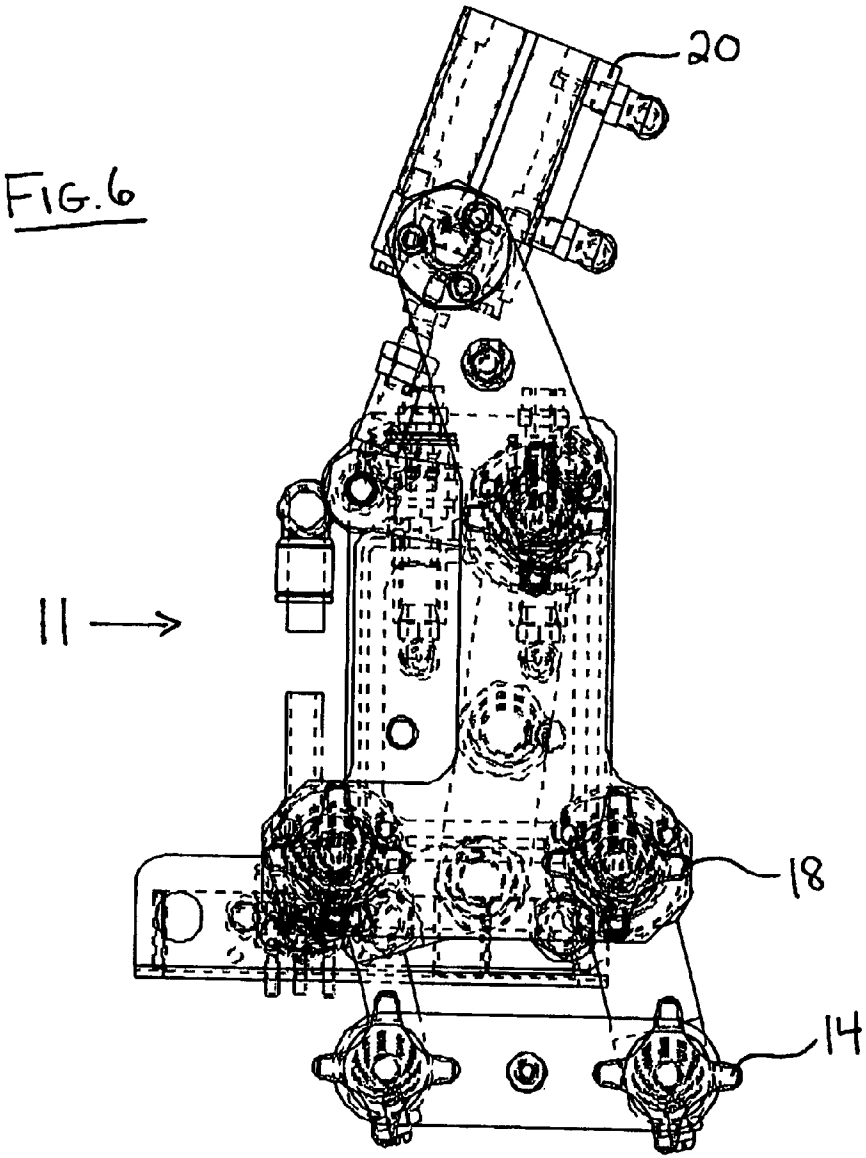
FIG. 6 is a close-up view of a presser device according to one possible embodiment as shown in FIG. 2.
Figure 7:
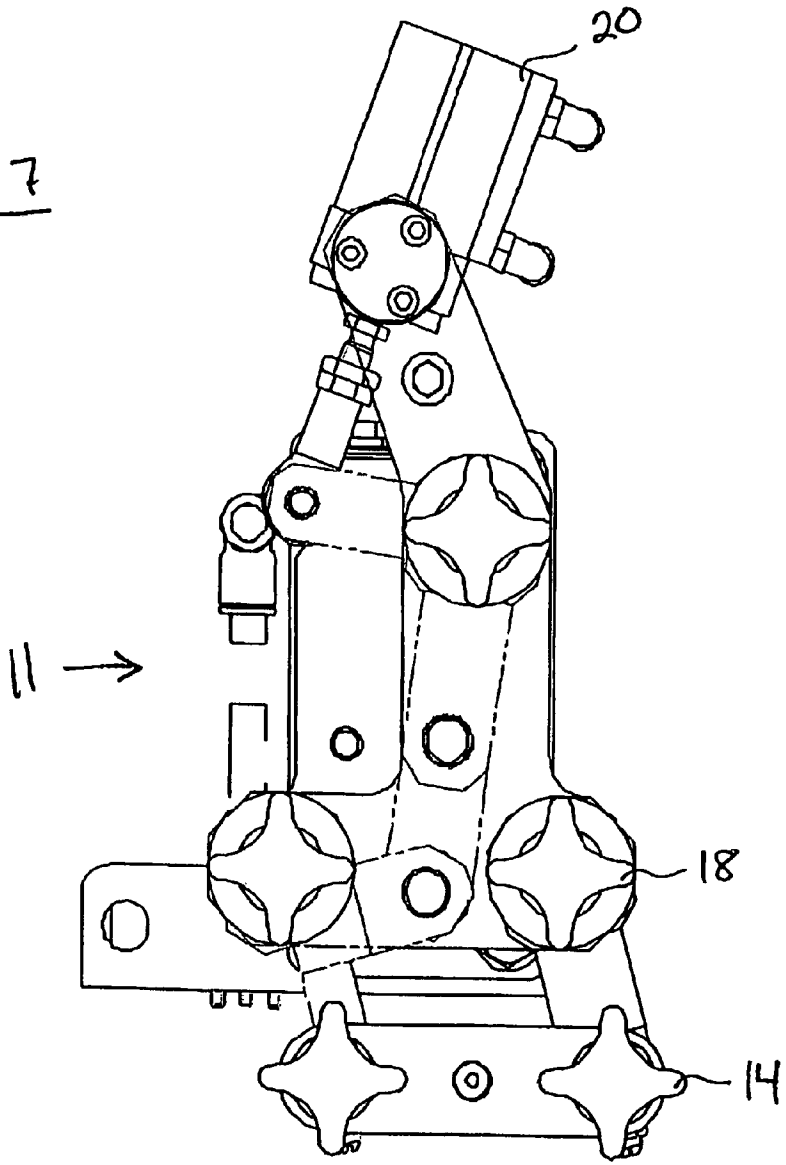
FIG. 7 is a close-up view of a presser device according to one possible embodiment.

FIG. 6 is a close-up X-Ray view of a presser device according to one possible embodiment as shown in FIG. 2. FIG. 7 is a close-up view of a presser device according to one possible embodiment. Both FIG. 6 and FIG. 7 show the presser device 11 without a presser element 13 attached thereto. The quick change element 14 is designed to permit the presser elements to be changed, for instance, to be used for bottles or containers of different shapes or sizes.

The present application relates to a device for the labeling of containers such as bottles, cans and other containers and packaging with a container conveyor and labeling stations arranged on its periphery so that they operate in alternation, with a label transfer and dispensing device for labels that are delivered on a carrier strip and adhere to it, which are adhesively applied by means of the dispensing device in the transfer area to the external surface of the bottle on which a rotational movement has been imposed, and with a presser device with a presser element to press and/or smooth the labels that are applied to the containers, whereby the presser element of an inactive labeling station can be moved from its operating position into a rest position which is at least slightly outside the plane of movement of the container.

One feature or aspect of an embodiment is believed at the time of the filing of this patent application to possibly reside broadly in a device for the labeling of containers such as bottles, cans and other containers and packaging with a container conveyor and labeling stations arranged on its periphery so that they operate in alternation, with a label transfer and dispensing device for labels that are delivered on a carrier strip and adhere to it, which are adhesively applied by means of the dispensing device in the transfer area to the external surface of the bottle on which a rotational movement has been imposed, and with a presser device with a presser element to press and/or smooth the labels applied to the containers, characterized by the fact that the presser element of an inactive labeling station can be moved from its operating position into a rest position which is at least slightly outside the plane of movement of the container.

Another feature or aspect of an embodiment is believed at the time of the filing of this patent application to possibly reside broadly in a device for labeling, characterized by the fact that the non-active labeling station can be moved together with the presser device out of an operating position into an idle, reloading and/or service position.

Yet another feature or aspect of an embodiment is believed at the time of the filing of this patent application to possibly reside broadly in a device for labeling, characterized by the fact that the presser element can be moved into an idle position and the labeling station into a reloading or service position.

Still another feature or aspect of an embodiment is believed at the time of the filing of this patent application to possibly reside broadly in a device for labeling 1, characterized by the fact that the presser device is part of the labeling station and can be moved together with the labeling station or independently of it out of the work position and vice-versa.

A further feature or aspect of an embodiment is believed at the time of the filing of this patent application to possibly reside broadly in a device for labeling, characterized by the fact that the presser element is mounted on a coupling mechanism so that it can be pivoted in and out.

Another feature or aspect of an embodiment is believed at the time of the filing of this patent application to possibly reside broadly in a device for labeling, characterized by the fact that the pivoting of the presser element and/or of the presser device takes place in the vertical plane.

Yet another feature or aspect of an embodiment is believed at the time of the filing of this patent application to possibly reside broadly in a device for labeling, characterized by the fact that the pivoting of the presser element and/or of the presser device takes place in the horizontal plane.

Still another feature or aspect of an embodiment is believed at the time of the filing of this patent application to possibly reside broadly in a device for labeling, characterized by the fact that the presser element has a plurality of presser elements that are located at intervals from each other and can be applied separately to the container to be labeled.

Yet another feature or aspect of an embodiment is believed at the time of the filing of this patent application to possibly reside broadly in a device for labeling, characterized by the fact that the presser elements and/or their container-side surface is/are made of elastically deformable material.

A further feature or aspect of an embodiment is believed at the time of the filing of this patent application to possibly reside broadly in a device for labeling, characterized by the fact that the presser elements are fastened to a movable holder element, on which a restoring force is exerted.

Another feature or aspect of an embodiment is believed at the time of the filing of this patent application to possibly reside broadly in a device for labeling, characterized by the fact that the presser elements or their holding parts are mounted by means of a quick-change device so that they can be replaced rapidly.

Yet another feature or aspect of an embodiment is believed at the time of the filing of this patent application to possibly reside broadly in a device for labeling, characterized by the fact that the presser elements are mounted so that they can be moved at least approximately radially forward and backward.

Still another feature or aspect of an embodiment is believed at the time of the filing of this patent application to possibly reside broadly in a device for labeling, characterized by the fact that the presser elements are mounted so that they can be moved at least approximately circularly forward and backward.

A further feature or aspect of an embodiment is believed at the time of the filing of this patent application to possibly reside broadly in a device for labeling, characterized by the fact that the presser elements have a contour that corresponds to the path of the corresponding rotating container surface.

Another feature or aspect of an embodiment is believed at the time of the filing of this patent application to possibly reside broadly in a device for labeling, characterized by the fact that the presser elements are formed from a plane that can be modified as necessary and can be adapted to the container surface to be processed.

Yet another feature or aspect of an embodiment is believed at the time of the filing of this patent application to possibly reside broadly in a device for labeling, characterized by the fact that the plane of the presser elements is divided into a plurality of sub-planes according to the material of the container and label to be processed, and these partial planes can be adjusted in their position so that they are automatically adjusted by means of automatically actuated adjustment elements of the pressure device with respect to the container surface to be processed.

Still another feature or aspect of an embodiment is believed at the time of the filing of this patent application to possibly reside broadly in a device for labeling, characterized by the fact that the presser elements can be positioned by means of a multi-axis positioning unit and/or corresponding associated rotation devices.

A further feature or aspect of an embodiment is believed at the time of the filing of this patent application to possibly reside broadly in a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; said beverage filling machine comprising a plurality of beverage filling elements for filling beverage bottles with liquid beverage material; at least one liquid reservoir being configured to hold a liquid to be bottled; said at least one liquid reservoir comprising a gas headspace being disposed above a liquid to be bottled within said at least one liquid reservoir; at least one supply line being configured and disposed to connect said at least one liquid reservoir to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling machine to said beverage bottle packing station; said fourth conveyer arrangement comprising a linear conveyor structure being configured and disposed to arrange beverage bottles in groups for packing; a control system being configured and disposed to monitor and control operation of said beverage bottling plant; said beverage bottle labeling machine comprising: a rotary bottle carrier being configured and disposed to carry bottles about the periphery of said rotary bottle carrier; a plurality of beverage bottle labeling stations; said plurality of beverage bottle labeling stations being disposed adjacent said rotary bottle carrier and being configured and disposed to attach labels to bottles on said rotary bottle carrier; said plurality of beverage bottle labeling stations being configured and disposed to operate in alternation; each of said plurality of beverage bottle labeling stations comprising: a label supply arrangement being configured and disposed to contain a supply of labels; a label transfer and dispensing device being configured and disposed to transfer and dispense labels from said label supply arrangement and onto the surface of bottles; a sensor being configured and disposed to determine when said label supply arrangement needs a new charge of labels, and to send a signal to said control system upon said label supply arrangement needing a new charge of labels; an engaged position for labeling containers and a disengaged position for refilling a charge of labels in said label supply arrangements; a labeling station actuator element being configured and disposed to move each of said plurality of beverage bottle labeling stations from said engaged position of its corresponding labeling station to said disengaged position of its corresponding labeling station upon receiving a signal from said control system; said labeling station actuator element being configured and disposed to move each of said plurality of beverage labeling stations from said disengaged position of its corresponding labeling station to said engaged position of its corresponding labeling station, upon receiving a signal from said control system; a presser device being configured and disposed to press labels onto a bottle upon a label being transferred to the surface of a bottle by said label transfer and dispensing device; said presser device comprising: a presser element being disposed adjacent said label transfer and dispensing device; said presser element being configured and disposed to press labels smoothly onto the surface of a bottle; a coupling device being configured and disposed to pivot said presser element substantially outside the plane of movement of bottles; a presser device actuator element being configured and disposed to drive the pivoting movement of said presser element about said coupling device.

Another feature or aspect of an embodiment is believed at the time of the filing of this patent application to possibly reside broadly in a method of operating a beverage bottling plant for filling bottles with liquid beverage material, said beverage bottling plant comprising: a rotary bottle carrier being configured and disposed to carry bottles about the periphery of said rotary bottle carrier; a plurality of beverage bottle labeling stations; said plurality of beverage bottle labeling stations being disposed adjacent said rotary bottle carrier and being configured and disposed to attach labels to bottles on said rotary bottle carrier; said plurality of beverage bottle labeling stations being configured and disposed to operate in alternation; each of said plurality of beverage bottle labeling stations comprising: a label supply arrangement being configured and disposed to contain a supply of labels; a label transfer and dispensing device being configured and disposed to transfer and dispense labels from said label supply arrangement and onto the surface of bottles; a sensor being configured and disposed to determine when said label supply arrangement needs a new charge of labels, and to send a signal to said control system upon said label supply arrangement needing a new charge of labels; an engaged position for labeling containers and a disengaged position for refilling a charge of labels in said label supply arrangements; a labeling station actuator element being configured and disposed to move each of said plurality of beverage bottle labeling stations from said engaged position of its corresponding labeling station to said disengaged position of its corresponding labeling station upon receiving a signal from said control system; said labeling station actuator element being configured and disposed to move each of said plurality of beverage labeling stations from said disengaged position of its corresponding labeling station to said engaged position of its corresponding labeling station, upon receiving a signal from said control system; a presser device being configured and disposed to press labels onto a bottle upon a label being transferred to the surface of a bottle by said label transfer and dispensing device; said presser device comprising: a presser element being disposed adjacent said label transfer and dispensing device; said presser element being configured and disposed to press labels smoothly onto the surface of a bottle; a coupling device being configured and disposed to pivot said presser element substantially outside the plane of movement of bottles; a presser device actuator element being configured and disposed to drive the pivoting movement of said presser element about said coupling device, said method comprising the steps of: transferring labels from said label transfer and dispensing device onto the surface of containers; pressing labels onto containers with said presser device; sensing when a label supply container needs to be changed with said sensor; sending a signal to said control system upon said label supply container needing to be changed; sending a signal from said control system to said labeling station actuator element and said presser device actuator element; pulling said labeling station and said presser device into a disengaged position to refill said label supply container; and pushing an already disengaged labeling station and presser device into the engaged position to label bottles and press labels onto containers.

Yet another feature or aspect of an embodiment is believed at the time of the filing of this patent application to possibly reside broadly in a device for the labeling of containers such as bottles, cans and other containers and packaging comprising: a container conveyor and labeling stations arranged adjacent said container conveyer; said labeling stations being configured to operate in alternation; a label transfer and dispensing device for labels that are delivered on a carrier strip with labels adhered thereto, which labels are applied by means of the dispensing device in the transfer area to the external surface of a container on which a rotational movement has been imposed; a presser device with a presser element to press and/or smooth the labels applied to the containers; said device for the labeling of containers wherein the presser element of an inactive labeling station is moveable from an operating position into a rest position which is at least substantially outside the path of movement of the container.

Some examples of bottling systems, which may be used or adapted for use in at least one possible embodiment of the present may be found in the following U.S. Patents assigned to the Assignee herein, namely: U.S. Pat. No. 4,911,285; No. 4,944,830; No. 4,950,350; No. 4,976,803; No. 4,981,547; No. 5,004,518; No. 5,017,261; No. 5,062,917; No. 5,062,918; No. 5,075,123; No. 5,078,826; No. 5,087,317; No. 5,110,402; No. 5,129,984; No. 5,167,755; No. 5,174,851; No. 5,185,053; No. 5,217,538; No. 5,227,005; No. 5,413,153; No. 5,558,138; No. 5,634,500; No. 5,713,403; No. 6,276,113; No. 6,213,169; No. 6,189,578; No. 6,192,946; No. 6,374,575; No. 6,365,054; No. 6,619,016; No. 6,474,368; No. 6,494,238; No. 6,470,922; and No. 6,463,964.

The components disclosed in the various publications, disclosed or incorporated by reference herein, may possibly be used in possible embodiments of the present invention, as well as equivalents thereof.

Some examples of rotation sensors that may possibly be utilized or possibly adapted for use in at least one possible embodiment of the present application may possibly be found in the following U.S. patents: U.S. Pat. No. 6,246,232 issued to Okamura on Jun. 12, 2001; U.S. Pat. No. 6,448,761 issued to Stumpe on Sep. 10, 2002; U.S. Pat. No. 6,474,162 to Voss et al. on Nov. 5, 2002; U.S. Pat. No. 6,498,481 issued to Apel on Dec. 24, 2002; U.S. Pat. No. 6,532,831 issued to Jin et al. on Mar. 18, 2003; and U.S. Pat. No. 6,672,175 issued to Jin et al. on Jan. 6, 2004.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The appended drawings in their entirety, including all dimensions, proportions and/or shapes in at least one embodiment of the invention, are accurate and are hereby included by reference into this specification.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of synchronous motors which may possibly be utilized or adapted for use in at least one possible embodiment may possibly be found in the following U.S. Patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of computer systems that may possibly be utilized or possibly adapted for use in at least one possible embodiment of the present application may possibly be found in the following U.S. Patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

All of the patents, patent applications and publications recited herein, and in the Declaration attached hereto, are hereby incorporated by reference as if set forth in their entirety herein.

Some examples of pneumatic arrangements that may possibly be utilized or possibly adapted for use in at least one possible embodiment of the present application may possibly be found in the following U.S. Patents: U.S. Pat. No. 6,609,767 issued to Mortenson et al. on Aug. 26, 2003; U.S. Pat. No. 6,632,072 issued to Lipscomb et al. on Oct. 14, 2003; U.S. Pat. No. 6,637,838 issued to Watanabe on Oct. 28, 2003; U.S. Pat. No. 6,659,693 issued to Perkins et al. on Dec. 9, 2003; U.S. Pat. No. 6,668,848 issued to Ladler et al. on Dec. 30, 2003; and U.S. Pat. No. 6,676,229 issued to Marra et al. on Jan. 13, 2004.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of adhesive applicators that may possibly be utilized or possibly adapted for use in at least one possible embodiment of the present application may possibly be found in the following U.S. Patents: U.S. Pat. No. 5,700,322 issued to Fort on Dec. 23, 1997 U.S. Pat. No. 5,862,986 issued to Bolyard, Jr. et al. on Jan. 26, 1999; U.S. Pat. No. 6,076,711 issued to McGuffey on Jun. 20, 2000; U.S. Pat. No. 6,168,049 issued to Bollard, Jr. on Jan. 2, 2001; U.S. Pat. No. 6,499,631 issued to Zook on Dec. 31, 2002; and U.S. Pat. No. 6,592,281 issued to Clark et al. on Jul. 15, 2003.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

In the event that automatic tool changes would be desirable in a possible embodiment, some examples of automatic tool changer apparatuses which may possibly be utilized or adapted for use in at least one possible embodiment may possibly be found in the following U.S. Patents: U.S. Pat. No. 5,300,006, entitled "Automatic tool changer;" U.S. Pat. No. 4,835,838, entitled "Automatic tool changer in machine tool;" U.S. Pat. No. 4,799,308, entitled "Automatic tool changer;" U.S. Pat. No. 4,773,152, entitled "Automatic tool changer;" U.S. Pat. No. 4,764,064, entitled "Tool changer;" U.S. Pat. No. 4,696,091, entitled "Automatic tool changer;" U.S. Pat. No. 4,614,137, entitled "Magnetic tool changer;" U.S. Pat. No. 4,610,074, entitled "Automatic tool changer of a machine tool;" U.S. Pat. No. 4,601,094, entitled "Turning machine with an automatic tool changer;" U.S. Pat. No. 4,499,650, entitled "Automatic tool changer;" U.S. Pat. No. 4,467,517, entitled "Tool changer for facing head;" U.S. Pat. No. 4,387,502, entitled "Semi-automatic tool changer;" and U.S. Pat. No. 4,329,770, entitled "Automatic tool changer."

The corresponding foreign application, namely, Federal Republic of Germany Patent Application No. 10 2004 029 788.6, filed on Jun. 19, 2004, having inventors Paul-Gerhard Kahlisch, Klaus-Friedrich Stock, and Heinz Thielmann, and DE-OS 10 2004 029 788.6 and DE-PS 10 2004 029 788.6, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of labeling machines which may possibly be utilized in at least one possible embodiment may possibly be found in the following U.S. patents: U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The details in the patents, patent applications and publications may be considered to be incorporable, at applicant's option, into the claims during prosecution as further limitations in the claims to patentably distinguish any amended claims from any applied prior art.

Some examples of position sensors or position sensor systems that may be used or adapted for use in at least one possible embodiment of the present invention may be found in the following U.S. patents: U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling beverage bottles with liquid beverage material, said beverage bottling plant comprising:

a beverage bottle cleaning machine being configured and disposed to clean beverage bottles;

a feed arrangement to supply beverage bottles to said beverage bottle cleaning machine;

a beverage filling machine being configured and disposed to fill beverage bottles with liquid beverage material;

said beverage filling machine comprising a plurality of beverage filling elements for filling beverage bottles with liquid beverage material;

at least one liquid reservoir being configured to hold a liquid to be bottled;

said at least one liquid reservoir comprising a gas headspace being disposed above a liquid to be bottled within said at least one liquid reservoir;

at least one supply line being configured and disposed to connect said at least one liquid reservoir to said beverage filling machine to supply liquid beverage material to said beverage filling machine;

a first conveyer arrangement being configured and disposed to move beverage bottles from said beverage bottle cleaning machine into said beverage filling machine;

said first conveyer arrangement comprising a star wheel structure;

a beverage bottle closing machine being configured and disposed to close tops of filled beverage bottles, a second conveyer arrangement being configured and disposed to move filled beverage bottles from said beverage filling machine into said beverage bottle closing machine;

said second conveyer arrangement comprising a star wheel structure;

a beverage bottle labeling machine being configured and disposed to label filled, closed beverage bottles;

a third conveyor arrangement being configured and disposed to move filled, closed beverage bottles from said beverage bottle closing machine into said beverage bottle labeling machine;

said third conveyer arrangement comprising a star wheel structure;

a beverage bottle packing station being configured and disposed to package labeled, filled, closed beverage bottles;

a fourth conveyor arrangement being configured and disposed to move labeled, filled, closed beverage bottles from said beverage bottle labeling machine to said beverage bottle packing station;

said fourth conveyer arrangement comprising a linear conveyor structure being configured and disposed to arrange beverage bottles in groups for packing;

a control system being configured and disposed to monitor and control operation of said beverage bottling plant;

said beverage bottle labeling machine comprising:

a rotary bottle carrier being configured and disposed to carry bottles about a periphery of said rotary bottle carrier;

a plurality of beverage bottle labeling stations;

said plurality of beverage bottle labeling stations being disposed adjacent said rotary bottle carrier and being configured and disposed to attach labels to bottles on said rotary bottle carrier;

said plurality of beverage bottle labeling stations being configured and disposed to operate in alternation;

each of said plurality of beverage bottle labeling stations comprising:

a label supply arrangement being configured and disposed to contain a supply of labels;

a label transfer and dispensing device being configured and disposed to transfer and dispense labels from said label supply arrangement and onto the surface of bottles;

a sensor being configured and disposed to determine when said label supply arrangement needs a new charge of labels, and to send a signal to said control system upon said label supply arrangement needing a new charge of labels;

an engaged position for labeling containers and a disengaged position for refilling a charge of labels in said label supply arrangements;

a labeling station actuator element being configured and disposed to move at least one of said plurality of beverage bottle labeling stations from said engaged position of its corresponding labeling station to said disengaged position of its corresponding labeling station upon receiving a signal from said control system in response to the signal from said sensor;

said labeling station actuator element being configured and disposed to move at least one of said plurality of beverage labeling stations from said disengaged position of its corresponding labeling station to said engaged position of its corresponding labeling station, upon receiving a signal from said control system;

a presser device being configured and disposed to press labels onto a bottle upon a label being transferred to the surface of a bottle by said label transfer and dispensing device;

said presser device comprising:

a presser element being disposed adjacent said label transfer and dispensing device;

said presser element being configured and disposed to press labels smoothly onto the surface of a bottle;

a coupling device being configured and disposed to pivot said presser element substantially outside a plane of movement of bottles;

a presser device actuator element being configured and disposed to drive the pivoting movement of said presser element about said coupling device.

2. The beverage bottling plant according to claim 1, wherein one of (A), (B), and (C):

(A) each of said labeling stations can be moved together with its corresponding presser device out of an operating position into an idle, reloading and/or service position;

(B) the presser element can be moved into an idle position and the labeling station into a reloading or service position;

(C) the presser device is part of the labeling station and can be moved together with the labeling station or independently of it out of a work position and vice-versa.

3. The beverage bottling plant according to claim 2, wherein:

the presser element is mounted on a coupling mechanism so that it can be pivoted in and out;

the pivoting of the presser element and/or of the presser device takes place in the vertical plane;

the pivoting of the presser element and/or of the presser device takes place in the horizontal plane;

the presser element has a plurality of presser elements that are located at intervals from each other and can be applied separately to bottles to be labeled;

the presser elements each comprise a side surface disposed to face toward bottles:

the presser elements and/or their side surfaces are made of elastically deformable material;

the presser elements are fastened to a movable holder element, on which a restoring force is exerted;

the presser elements or their coupling elements are mounted by means of a quick-change device so that they can be replaced rapidly;

the presser elements are mounted so that they can be moved at least approximately radially forward and backward;

the presser elements are mounted so that they can be moved at least approximately circularly forward and backward;

the presser elements have a contour that corresponds to a path of a corresponding rotating surface of a bottle;

the presser elements are formed from a plane that can be modified as necessary and can be adapted to a surface of a bottle to be processed;

the plane of the presser elements is divided into a plurality of sub-planes according to the material of a bottle and label to be processed, and these sub-planes can be adjusted in their position so that they are automatically adjusted by means of automatically actuated adjustment elements of the pressure device with respect to a surface of a bottle to be processed; and the presser elements can be positioned by means of a multi-axis positioning unit and/or corresponding associated rotation devices.

4. The beverage bottling plant according to claim 1, wherein said presser element of an inactive labeling station is configured to move from an operating position into a rest position which is at least substantially outside a path of movement of the beverage bottles.

5. The beverage bottling plant according to claim 4, wherein each of said labeling stations can be moved together with its corresponding presser device out of an operating position into an idle, reloading and/or service position.

6. The beverage bottling plant according to claim 5, wherein the presser element can be moved into an idle position and the labeling station into a reloading or service position.

7. The beverage bottling plant according to claim 6, wherein the presser device is part of the labeling station and can be moved together with the labeling station or independently of it out of the work position and vice-versa.

8. The beverage bottling plant according to claim 7, wherein the presser element is mounted on a coupling mechanism so that it can be pivoted in and out.

9. The beverage bottling plant according to claim 8, wherein the pivoting of the presser element and/or of the presser device takes place in the vertical plane.

10. The beverage bottling plant according to claim 9, wherein the pivoting of the presser element and/or of the presser device takes place in the horizontal plane.

11. The beverage bottling plant according to claim 10, wherein the presser element has a plurality of presser elements that are located at intervals from each other and can be applied separately to bottles to be labeled.

12. The beverage bottling plant according to claim 11, wherein the presser elements each comprise a side surface disposed to face toward bottles; and the presser elements and/or their side surfaces are made of elastically deformable material.

13. The beverage bottling plant according to claim 12, wherein the presser elements are fastened to a movable holder element, on which a restoring force is exerted.

14. The beverage bottling plant according to claim 13, wherein the presser elements or their holding parts are mounted by means of a quick-change device so that they can be replaced rapidly.

15. The beverage bottling plant according to claim 14, wherein the presser elements are mounted so that they can be moved at least approximately radially forward and backward.

16. The beverage bottling plant according to claim 15, wherein the presser elements are mounted so that they can be moved at least approximately circularly forward and backward.

17. The beverage bottling plant according to claim 16, wherein the presser elements have a contour that corresponds to a path of a corresponding rotating surface of a bottle.

18. The beverage bottling plant according to claim 17, wherein the presser elements are formed from a plane that can be modified as necessary and can be adapted to a surface of a bottle to be processed.

19. The beverage bottling plant according to claim 18, wherein the plane of the presser elements is divided into a plurality of sub-planes according to the material of a bottle and label to be processed, and these sub-planes can be adjusted in their position so that they are automatically adjusted by means of automatically actuated adjustment elements of the pressure device with respect to a surface of a bottle to be processed.

20. The beverage bottling plant according to claim 19, wherein the presser elements can be positioned by means of a multi-axis positioning unit and/or corresponding associated rotation devices.

* * * * *